US010672324B2

(12) United States Patent
Kong et al.

(10) Patent No.: US 10,672,324 B2
(45) Date of Patent: Jun. 2, 2020

(54) GATE DRIVER AND ELECTROLUMINESCENCE DISPLAY DEVICE INCLUDING THE SAME

(71) Applicant: LG DISPLAY CO., LTD., Seoul (KR)

(72) Inventors: ChungSik Kong, Paju-si (KR); MiHee Shin, Goyang-si (KR); GyuTae Kang, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/107,276

(22) Filed: Aug. 21, 2018

(65) Prior Publication Data

US 2019/0156732 A1 May 23, 2019

(30) Foreign Application Priority Data

Nov. 21, 2017 (KR) ..... 10-2017-0155741

(51) Int. Cl.
*G09G 3/36* (2006.01)
*G09G 3/30* (2006.01)
*G09G 3/3266* (2016.01)

(52) U.S. Cl.
CPC ..... *G09G 3/30* (2013.01); *G09G 3/3266* (2013.01); *G09G 2300/0408* (2013.01); *G09G 2310/0267* (2013.01); *G09G 2310/0286* (2013.01); *G09G 2310/08* (2013.01); *G09G 2320/0209* (2013.01); *G09G 2320/0233* (2013.01)

(58) Field of Classification Search
CPC ..... G09G 3/3266; G09G 3/3674; G09G 2310/0286
USPC ..... 345/100
See application file for complete search history.

(56) References Cited

U.S. PATENT DOCUMENTS

2014/0346520 A1* 11/2014 Kim ..... H01L 27/1255 257/59
2017/0116926 A1* 4/2017 Bong ..... G09G 3/3266
2019/0005867 A1* 1/2019 Hao ..... G09G 3/20

* cited by examiner

*Primary Examiner* — Roy P Rabindranath
(74) *Attorney, Agent, or Firm* — Birch, Stewart, Kolasch & Birch, LLP

(57) ABSTRACT

An electroluminescent display device includes sub-pixels connected to gate lines, and a gate driver configured to supply a scan signal to at least one of the gate lines, and including stages. One of the stages includes a QB-node regulation unit configured to charge a QB-node and a QP-node to turn-on voltage by using a first gate clock signal and a second gate clock signal, and a pull-down unit configured to output a turn-off voltage in response to a voltage of the QP-node. The QB-node regulation unit includes a QP-node control part configured to invert a phase of a voltage of a Q1-node and apply the voltage of the inverted phase to the QP-node, and a QB-node control part configured to bootstrap the QP-node. Accordingly, by employing the gate driver including the QB-node regulation unit that provides a stable voltage to the QB-node and the QP-node, the reliability of the gate driver can be improved, and the bezel of the electroluminescence display device can be reduced.

15 Claims, 7 Drawing Sheets

GATE DRIVER AND ELECTROLUMINESCENCE DISPLAY DEVICE INCLUDING THE SAME

CROSS-REFERENCE TO RELATED APPLICATIONS

This application claims the priority of Korean Patent Application No. 10-2017-0155741 filed on Nov. 21, 2017, in the Korean Intellectual Property Office, the disclosure of which is incorporated herein by reference.

BACKGROUND

Technical Field

The present disclosure relates to a gate driver with improved performance and an electroluminescent display device including the same.

Description of the Related Art

As the information technology evolves, the market for display devices as media providing users with information is growing. Accordingly, various types of display devices such as an electroluminescence display device, a liquid-crystal display device and a quantum-dot display device are increasingly used.

A display device includes a display panel including a plurality of sub-pixels, a driver unit for driving the display panel, a power supply unit for supplying power to the display panel, etc. The driver unit includes a gate driver for supplying gate signals to the display panel, a data driver for supplying data signals to the display panel, etc.

For example, an electroluminescent display device can display images by supplying gate signals, data signals, etc. to sub-pixels so that light-emitting elements of the selected sub-pixels emit light. The light-emitting element can be implemented based on an organic material or an inorganic material.

An electroluminescent display device has various advantages because it displays images based on light generated from light-emitting elements in the sub-pixels. Accordingly, it is necessary to improve the accuracy of pixel driving circuits for controlling the emission of the sub-pixels. If the voltage is not accurately applied to the sub-pixels, there can be image quality issues such as uneven luminance in the vertical direction and cross-talk on the display panel.

In view of the above, a technique is under development for improving the accuracy of a gate driver of an electroluminescent display device to accurately transmit signals to sub-pixels.

SUMMARY

A display panel, which can be the minimum operable element of the electroluminescent display device, is driven using one or more scan signals. A display panel includes an active area in which a pixel array, which is a set of sub-pixels, is disposed to display images, and a non-active area in which no image is displayed. The sub-pixels are driven using one or more scan signals. Agate driver to supply scan signals can be embedded in a display panel in the form of thin-film transistors together with a pixel array. Such a gate driver embedded in the display panel is known as a GIP (Gate In Panel) circuit. The GIP circuit can be implemented as a shift register. The shift register includes a plurality of stages, and the plurality of stages generate an output upon receiving a start signal. The output can be shifted according to a clock signal. The gate driver includes stages each including a plurality of transistors. The stages are cascaded to generate outputs sequentially. The number of stages of the gate driver can be equal to the number of gate lines. Each of the stages can output a scan signal to the respective gate lines. The plurality of transistors can be implemented in the form of thin-film transistors.

Each of the stages includes a Q-node for controlling a pull-up transistor, and a QB-node for controlling a pull-down transistor. Each of the stages can include transistors for charging the Q-node and discharging the QB-node or vice versa in response to a start signal and a clock signal. The start signal of each of the stages can be the output signal from the previous one, except the first stage.

When the QB-node is charged, the Q-node is discharged, and vice versa. For example, when a gate-on voltage is applied to the Q-node, a gate-off voltage is applied to the QB-node. When the gate-off voltage is applied to the Q-node, the gate-on voltage is applied to the QB-node. As the pull-up transistor and pull-down transistor are turned on or off, a gate-on voltage or a gate-off voltage can be provided to the pixel array. Since the pull-down transistor has a turn-on time longer than a turn-off time, it is necessary to stably apply a gate-on voltage to the QB-node. For example, when the transistors of the gate driver are p-type transistors, the gate-on voltage is a gate-low voltage and the gate-off voltage is a gate-high voltage. When the transistors included in the sub-pixels controlled by gate signals are n-type transistors, the gate-on voltage is the gate-high voltage and the gate-off voltage is the gate-low voltage. The types of the transistors of the gate driver and the sub-pixels are not limited thereto.

The gate driver can be implemented in various forms, and research is ongoing to develop optimal circuit configurations to improve the reliability of operation.

In view of the above, the inventors of the application have recognized the above-described issues, and have devised a gate driver having improved accuracy of scan signals to be applied to gate lines, and an electroluminescent display device including the same.

An object of the present disclosure is to provide a gate driver including a QB-node regulation unit for stabilizing a voltage of a QB-node and supplying the voltage accurately.

Another object of the present disclosure is to provide an electroluminescent display device with a reduced bezel by way of forming a gate driver that can output a scan signal more accurately.

Another object of the present disclosure is to provide a gate driver with improved reliability, and an electroluminescent display device including the same.

It should be noted that objects of the present disclosure are not limited to the above-described objects, and other objects of the present disclosure will be apparent to those skilled in the art from the following descriptions.

According to an aspect of the present disclosure, there is provided an electroluminescent display device comprising sub-pixels connected to gate lines, and a gate driver configured to supply a scan signal to at least one of the gate lines, and including stages. One of the stages comprises a QB-node regulation unit configured to charge a QB-node and a QP-node to turn-on voltage by using a first gate clock signal and a second gate clock signal, and a pull-down unit configured to output a turn-off voltage in response to a voltage of the QP-node. The QB-node regulation unit comprises a QP-node control part configured to invert a phase of a voltage of a Q1-node and apply the voltage of the inverted phase to the QP-node, and a QB-node control part configured to bootstrap the QP-node. Accordingly, by employing the gate driver including the QB-node regulation unit that provides a stable voltage to the QB-node and the QP-node, the reliability of the gate driver can be improved, and the bezel of the electroluminescence display device can be reduced.

According to another aspect of the present disclosure, there is provided a gate driver including a pull-up transistor having a gate electrode connected to a Q2-node to output a turn-on voltage, a pull-down transistor having a gate electrode connected to a QP-node to output a turn-off voltage, and a QB-node regulation unit configured to periodically provide a voltage greater than the turn-on voltage to the QP-node and periodically provide the turn-on voltage to the QB-node, with the turn-off voltage applied to the gate electrode of the pull-up transistor. Accordingly, the gate driver includes the QB-node regulation unit that provides a stable voltage to the QB-node and the QP-node, so that the reliability of the gate driver can be improved.

The details of one or more embodiments of the subject matter described in this specification are set forth in the accompanying drawings and the description below.

According to embodiments of the present disclosure, a gate driver includes a QB-node regulation unit that applies a stable voltage to a QB-node without a threshold voltage drop, thereby improving the reliability of a transistor connected to the QB-node.

According to embodiments of the present disclosure, a gate driver includes a QP-node control part that applies a voltage that is equal to or greater than a gate-on voltage to a QP-node, so that the reliability of a transistor connected to the QP-node can be improved and the size thereof can be reduced. Accordingly, the bezel of the electroluminescent display device can be reduced.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE DISCLOSURE

Figure 1:
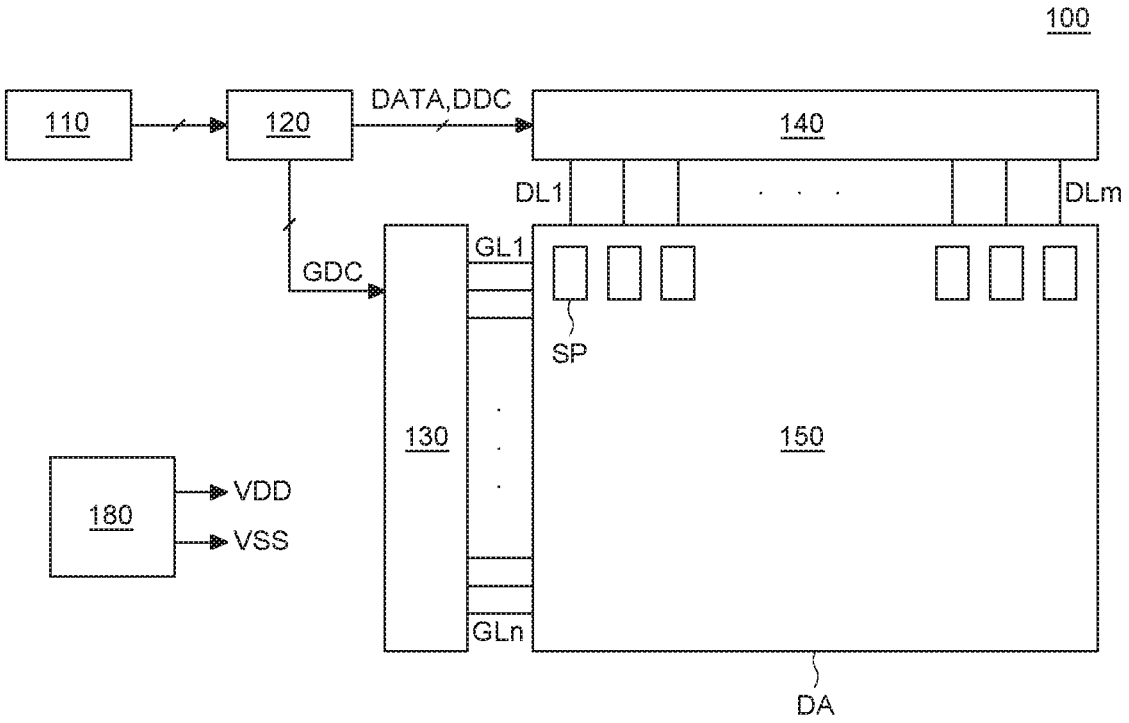
FIG. 1 is a block diagram of an electroluminescent display device according to an embodiment of the present disclosure.

Advantages and features of the present disclosure and methods to achieve them will become apparent from the descriptions of embodiments hereinbelow with reference to the accompanying drawings. However, the present disclosure is not limited to embodiments disclosed herein but can be implemented in various different ways. The embodiments are provided for making the disclosure of the present disclosure thorough and for fully conveying the scope of the present disclosure to those skilled in the art. It is to be noted that the scope of the present disclosure is defined only by the claims.

The figures, dimensions, ratios, angles, the numbers of elements given in the drawings are merely illustrative and are not limiting. Like reference numerals denote like elements throughout the descriptions. And, in describing the present disclosure, descriptions on well-known technologies can be omitted in order not to unnecessarily obscure the gist of the present disclosure. It is to be noticed that the terms "comprising," "having," "including" and so on, used in the description and claims, should not be interpreted as being restricted to the means listed thereafter unless specifically stated otherwise. Where an indefinite or definite article is used when referring to a singular noun, e.g. "a," "an," "the," this includes a plural of that noun unless specifically stated otherwise.

In describing elements, they are interpreted as including error margins even without explicit statements.

In describing positional relationship, such as "an element A on an element B," "an element A above an element B," "an element A below an element B," and "an element A next to an element B," another element C can be disposed between the elements A and B unless the term "directly" or "immediately" is explicitly used.

In describing temporal relationship, terms such as "after," "subsequent to," "next to" and "before" are not limited to "directly after," "directly subsequent to," "immediately next to" "immediately before," and so on, unless otherwise specified.

Features of various embodiments of the present disclosure can be combined partially or totally. As will be clearly appreciated by those skilled in the art, technically various interactions and operations are possible. Various embodiments can be practiced individually or in combination.

Herein, the pixel driving circuit and the gate driver formed on the substrate of the display panel can be implemented with n-type or p-type transistors. For example, the transistors can be implemented as metal oxide semiconductor field effect transistors (MOSFETs). A transistor is a three-electrode device including a gate electrode, a source electrode, and a drain electrode. The source electrode is an electrode for supplying carriers to the transistor. In the transistor, carriers begin to flow from the source electrode. The carries exit the transistor via the drain electrode. For example, carriers flow in a transistor from the source electrode to the drain electrode. For an n-type transistor, the carriers are electrons, and thus the level of the source voltage is lower than the level of the drain voltage so that the electrons flow from the source electrode to the drain electrode. In an n-type transistor, as electrons flow from the source electrode to the drain electrode, the current flows from the drain electrode to the source electrode. For a p-type transistor, the carriers are holes, and thus the level of the source voltage is higher than the level of the drain voltage so that the holes flow from the source electrode to the drain electrode. In a p-type transistor, as holes flow from the source electrode to the drain electrode, the current flows from the source electrode to the drain electrode. The source electrode and the drain electrode of a transistor are not fixed but can be interchanged according to the applied voltage. Thus, the source electrode and the drain electrode can be referred to as a first electrode and a second electrode or a second electrode and a first electrode.

In the following description, a gate-on voltage can refer to the voltage of a gate signal to turn on a transistor. A gate-off voltage can refer to the voltage to turn off a transistor. In a p-type transistor, the gate-on voltage can be a gate-low voltage VGL, and the gate-off voltage can be a gate-high voltage VGH. In an n-type transistor, the gate-on voltage can be a gate-high voltage, and the gate-off voltage can be a gate-low voltage.

Hereinafter, a gate driver according to an embodiment of the present disclosure and a display device such as an electroluminescent display device including the gate driver will be described with reference to the accompanying drawings.

FIG. 1 is a block diagram of an electroluminescent display device according to an embodiment of the present disclosure. All components of the electroluminescent display device according to all embodiments of the present disclosure are operatively coupled and configured.

Referring to FIG. 1, an electroluminescent display device 100 includes an image processor 110, a timing controller 120, a gate driver 130, a data driver 140, a display panel 150, and a power supply 180.

The image processor 110 outputs image data supplied from an external source and driving signals for driving various elements. The driving signals output from the image processor 110 can include a data enable signal, a vertical synchronization signal, a horizontal synchronization signal, and a clock signal.

The timing controller 120 receives the image data and the driving signals supplied from the image processor 110. Based on the driving signals, the timing controller 120 outputs a gate timing control signal GDC for controlling the operation timing of the gate driver 130, a data timing control signal DDC for controlling the operation timing of the data driver 140, and a data signal DATA containing luminance information of an image to be displayed on the display panel 150.

The gate driver 130 outputs a scan signal in response to a gate timing control signal GDC supplied from the timing controller 120. The gate driver 130 outputs gate signals through the gate lines GL1 to GLn. The gate driver 130 can be implemented as either an integrated circuit (IC) or a gate-in-panel (GIP) circuit embedded in the display panel 150. The gate driver 130 can be disposed on each of the left and right sides of the display panel 150 or can be disposed on one of the sides. In addition, the gate driver 130 includes a plurality of stages. For example, a first stage of the gate driver 130 outputs a first gate signal to a first gate line of the display panel 150.

The data driver 140 outputs a data voltage in response to a data timing control signal DDC supplied from the timing controller 120. The data driver 140 samples and latches the digital data signal DATA supplied from the timing controller 120 to convert it into an analog data signal based on a gamma reference voltage. The data driver 140 outputs data signals through the data lines DL1 to DLm. The data driver 140 can be formed on the display panel 150 as an integrated circuit (IC) or as a chip-on-film (COF).

The power supply 180 outputs a high-potential supply voltage VDD and a low-potential supply voltage VSS. The high-potential supply voltage VDD and the low-potential supply voltage VSS output from the power supply 180 are supplied to the display panel 150. The high-potential supply voltage VDD is supplied to the display panel 150 through a high-potential supply line, and the low-potential supply voltage VSS is supplied to the display panel 150 through a low-potential supply line. The voltage output from the power supply 180 can be used in the gate driver 130 or the data driver 140.

The display panel 150 displays an image in response to the gate signals and the data signals supplied from the gate driver 130 and the data driver 140 respectively and the supply voltages supplied from the power supply 180. The display panel 150 includes a pixel array operable to display an image. The pixel array includes sub-pixels SP.

The display panel 150 includes a display area DA where sub-pixels SP are disposed, and a non-display area NDA formed around the display area DA where various signal lines, pads, etc. are formed. In the display area DA, the sub-pixels are disposed to display images. In the non-display area NDA, dummy sub-pixels are disposed or no sub-pixel is disposed, to display no image.

The display area DA includes a plurality of sub-pixels SP, and displays an image based on the grayscale represented by each of the sub-pixels SP. Each of the sub-pixels SP is connected to a data line DL extended along a column line, and connected to a gate line extended along a pixel line or a row line. The sub-pixels SP arranged on the same pixel line share the same gate line and are driven simultaneously. Let us define the sub-pixels SP connected to the first gate line as the first sub-pixels, and the sub-pixels SP connected to the $n^{th}$ gate line as the $n^{th}$ sub-pixels. The sub-pixels are driven sequentially from the first sub-pixels to the $n^{th}$ sub-pixels.

The sub-pixels SP can be arranged, but is not limited to, in a matrix, to forma pixel array. The sub-pixels SP can be arranged in various forms, e.g., in a stripe shape, in a diamond shape, etc., in addition to a matrix.

The sub-pixels SP can include a red sub-pixel, a green sub-pixel, and a blue sub-pixel or can include a white sub-pixel, a red sub-pixel, a green sub-pixel, and a blue sub-pixel. The sub-pixels SP can have one or more different emission areas depending on the emission characteristics.

Figure 2:
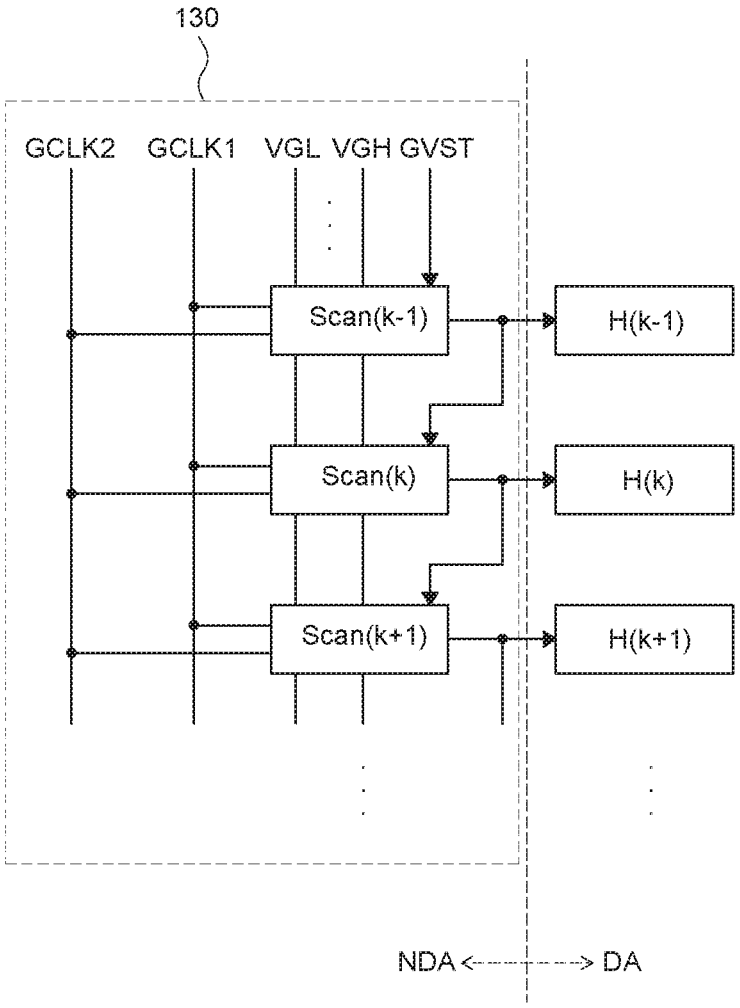
FIG. 2 is a block diagram of a gate driver of a display device according to an embodiment of the present disclosure.

FIG. 2 is a block diagram of a gate driver according to an embodiment of the present disclosure. In more detail, FIG. 2 shows a gate driver according to an embodiment of the present disclosure and pixel lines via which signals output from the gate driver are transmitted.

As described above, the display panel 150 includes a display area DA for displaying an image based on sub-pixels SP, and a non-display area NDA in which signal lines or drivers are disposed and no image is displayed.

Each of the sub pixels SP includes a pixel driving circuit for controlling the amount of current applied to the light-emitting element. The pixel driving circuit can include a driving transistor for controlling the amount of current so that a constant current can flow through the light-emitting element. The light-emitting element emits light during an emission period and does not emit light during other periods than the emission period. During other periods than the emission period, the pixel driving circuit is initialized, a scan signal is input to the pixel driving circuit, such that a programming and pixel driving circuit compensation period can proceed.

The gate signals for driving the sub-pixels SP included in the electroluminescent display panel 100 includes one or more scan signals. For example, two scan signals are applied to the sub-pixels SP through two scan lines, respectively.

As shown in FIG. 2, the gate driver 130 according to the embodiment of the present disclosure includes a first scan stage Scan(1) to an $n^{th}$ scan stage Scan(n). Here, the $k^{th}$ scan stage Scan(k) is shown as an example, where k is a natural number that satisfies $1 \leq k \leq n$.

The gate driver 130 includes lines through which a first gate clock signal GCLK1, a second gate clock signal GCLK2, a gate-low voltage VGL, a gate-high voltage VGH and a gate-start voltage GVST are input to the $k^{th}$ scan stage Scan(k). The $k^{th}$ scan stage Scan(k) shifts the gate-start voltage GVST in response to the first gate clock signal GCLK1 and the second gate clock signal GCLK2 and provides a scan signal to the $k^{th}$ pixel line H(k). By doing so, the gate-start voltage GVST is input to the first scan stage Scan(1), and each of the second scan stage Scan(2) to the $n^{th}$ scan stage Scan(n) receives the scan signal output from the previous stage as a start signal. The first gate clock signal GCLK1 and the second gate clock signal GCLK2 can swing between the gate-high voltage and the gate-low voltage and can be in reversed phase to each other. The first gate clock signal GCLK1 and the second gate clock signal GCLK2 can be in reversed phase to each other, and can have different gate clock cycles. For example, the gate clock cycle of the first gate clock signal GCLK1 can be longer than the gate clock cycle of the second gate clock signal GCLK2.

Although the two-phase circuit that provides the first gate clock signal GCLK1 and the second gate clock signal GCLK2 to the gate driver 130 is shown, the present disclosure is not limited thereto.

Figure 3:
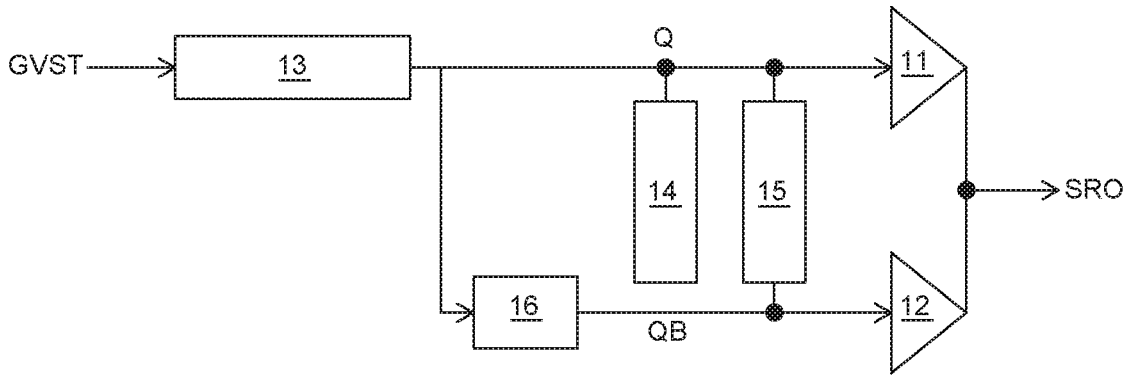
FIG. 3 is a block diagram of a stage according to an embodiment of the present disclosure.

FIG. 3 is a block diagram of a stage according to an embodiment of the present disclosure. As described above, the gate driver 130 includes a plurality of stages. FIG. 3 is a block diagram showing the elements of one of the plurality of stages. Thus, each of the plurality of stages of the gate driver according to the present disclosure can have the configuration as shown in FIG. 3.

Referring to FIG. 3, a stage includes a pull-up unit 11, a pull-down unit 12, a Q-node control unit 13, a Q-node stabilization unit 14, a QB-node stabilization unit 15 and a QB-node regulation unit 16. Among these, the Q-node stabilization unit 14 and the QB-node stabilization unit 15 may be omitted.

The pull-up unit 11 outputs a scan signal in response to the voltage of the Q-node Q. The pull-down unit 12 holds the scan signal to a gate-off voltage in response to the voltage of the Q-node Q and/or the voltage of the QB-node QB.

The Q-node control unit 13 is an element for charging or discharging the Q-node Q. The Q-node control unit 13 applies the gate-on voltage to the Q-node Q using the gate-start voltage GVST.

The QB-node regulation unit 16 receives a signal output from the Q-node control unit 13, for example, a signal applied to the Q-node Q, and outputs the signal to the QB-node QB. The gate-off voltage is output to the QB-node QB while the Q-node control unit 13 outputs the gate-on voltage to the Q-node Q. In addition, the gate-on voltage is output to the QB-node QB while the Q-node control unit 13 outputs the gate-off voltage to the Q-node Q. The QB-node regulation unit 16 can include a plurality of transistors. For example, when the plurality of transistors of the QB-node regulation unit 16 are p-type transistors, if the gate-low voltage is directly applied to the QB-node QB through a transistor that is controlled by the gate clock signal and is connected between the QB-node QB and the gate-low voltage line, the voltage applied to the QB-node QB can not be the gate-low voltage due to the threshold voltage of the transistor. In other words, a voltage equal to the difference between the gate-low voltage and the threshold voltage of the transistor is applied to the QB-node QB. The voltage applied to the QB-node QB cannot stably turn on the pull-down unit 12, and thus cannot stably apply a scan signal of the gate-off voltage to the gate line. A circuit diagram of the QB-node adjuster 16 for solving this will be described later. Since the period of a frame during which the gate-on voltage is applied as the scan signal corresponds to the cycle of the gate clock signal, and the gate-off voltage is applied during the other periods, it is important to implement a gate driver so that the voltage of the QB-node QB is stably held at the gate-off voltage. If the gate-off voltage is not accurately applied to the scan signal, image quality defects can occur.

The Q-node stabilization unit 14 can divide the Q-node Q into two-nodes, so that the influence of a change in the voltage applied to one of the-nodes on the transistors connected to the other-node can be reduced.

While the scan signal output terminal SRO outputs the gate-on voltage, the QB-node stabilization unit 15 applies the gate-high voltage VGH to the QB-node QB, so that the QB-node QB stably holds the gate-off voltage.

Figure 4:
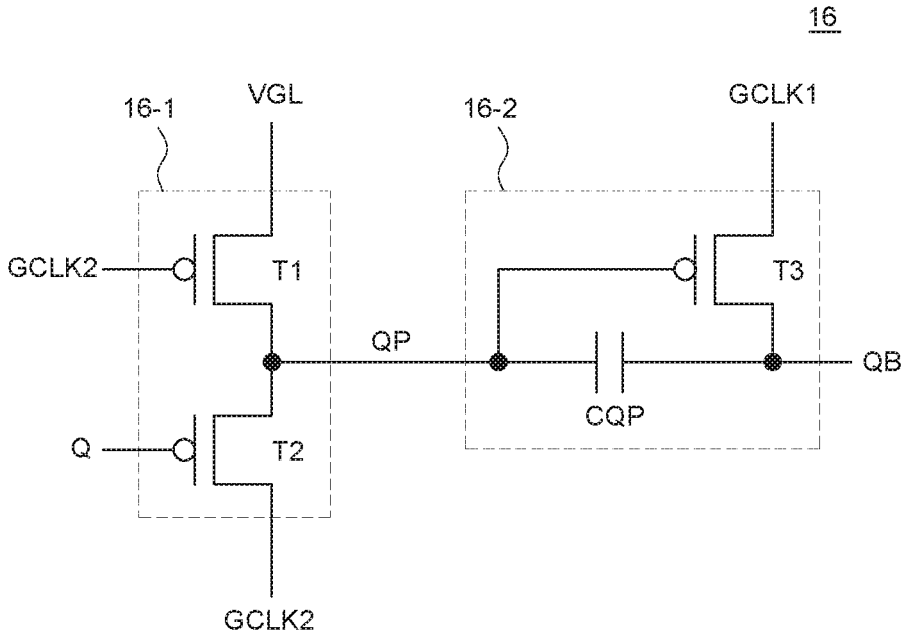
FIG. 4 is a block diagram showing a QB-node regulation unit according to an embodiment of the present disclosure.

FIG. 4 is a block diagram showing a QB-node regulation unit according to an embodiment of the present disclosure. In more detail, FIG. 4 is a block diagram of an example of the QB-node regulation unit 16 of FIG. 3.

Hereinafter, the transistors of the QB-node regulation unit 16 will be described as p-type transistors, but other variations are part of the present disclosure.

The QB-node regulation unit 16 includes a QP-node control part 16-1 and a QB-node control part 16-2. The QP-node control part 16-1 inverts a phase of the voltage of the Q-node Q and outputs the voltage of the inverted phase of the Q-node to the QP-node QP. The QB-node control part 16-2 is connected between the QP-node QP and the QB-node QB to bootstrap the QP-node QP with a first capacitor CQP included therein and outputs a stable voltage to the QB-node QB.

The QP-node control part 16-1 includes a first transistor T1 and a second transistor T2. The first transistor T1 includes a gate electrode connected to a second gate clock signal line to which the second gate clock signal GCLK2 is input, a source electrode connected to the gate-low voltage VGL, and a drain electrode connected to the QP-node QP. The second transistor T2 includes a gate electrode connected to the Q-node Q, a source electrode connected to the second gate clock signal line to which the second gate clock signal GCLK2 is input, and a drain electrode connected to the QP-node QP. During a period in which the Q-node Q has the gate-off voltage, the second transistor T2 is turned off, and the first transistor T1 is turned on and off repeatedly by the second gate clock signal GCLK2 and applies the gate-low voltage VGL to the QP-node QP. During a period in which the Q-node Q has the gate-on voltage, the second transistor T2 is turned on and applies the gate-off voltage of the second gate clock signal GCLK2 to the QP-node QP. In other words, the QP-node control part 16-1 inverts a phase of the voltage of the Q-node Q and outputs the voltage of the inverted phase to the QP-node QP.

The QB-node control part 16-2 includes a third transistor T3 and a first capacitor CQP. The third transistor T3 includes a gate electrode connected to the QP-node QP, a source electrode connected to the first gate clock signal line to which the first gate clock signal GCLK1 is input, and a drain electrode connected to the QB-node QB. In addition, the first and second electrodes of the first capacitor CQP are connected to the QP-node QP and the QB-node QB, respectively. When the voltage of the QP-node QP is the gate-on voltage, the third transistor T3 applies the gate-low voltage of the first gate clock signal GCLK1 to the QB-node QB. The gate-low voltage of the QP-node QP becomes lower than the gate-low voltage of the QB-node QB due to the bootstrapping with the first capacitor CQP, and the gate-low voltage of the first gate clock signal GCLK1 can be stably applied to the QB-node QB.

Figure 5:
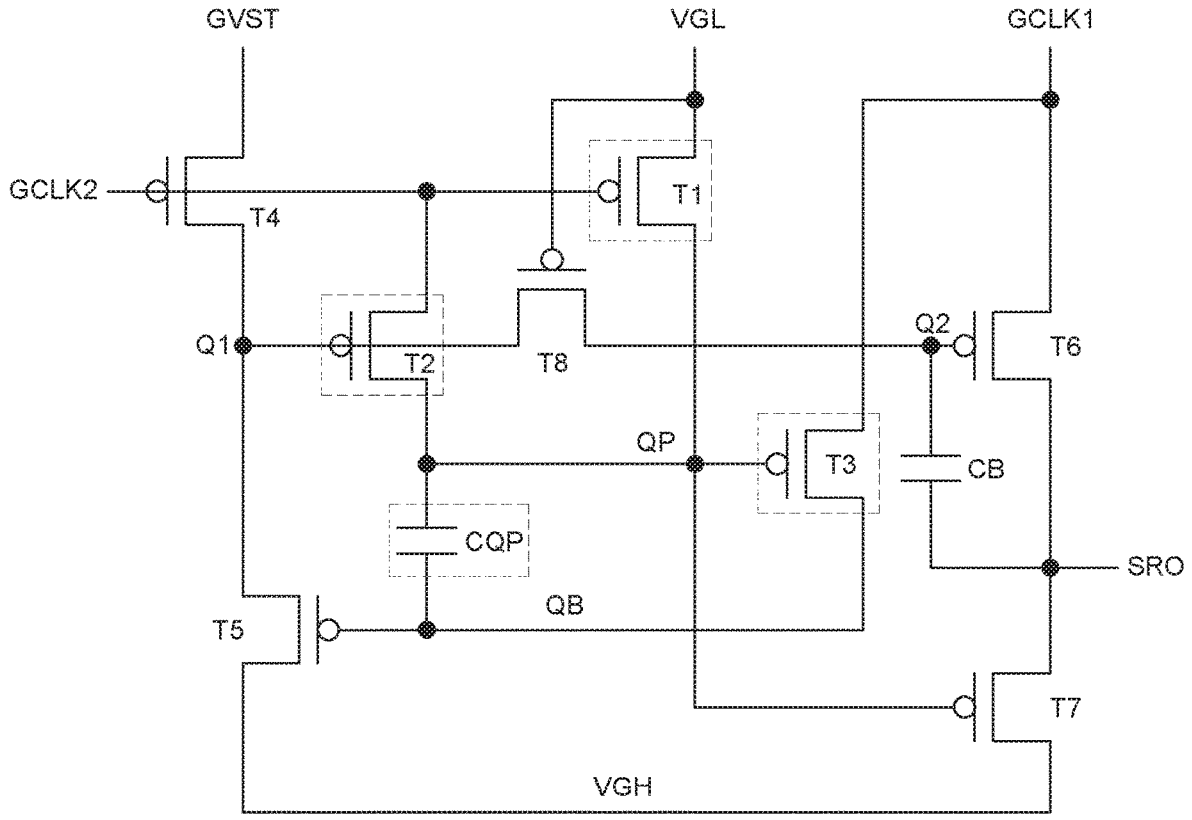
FIG. 5 is a circuit diagram of a gate driver of a display device according to a first embodiment of the present disclosure.

FIG. 5 is a circuit diagram of a gate driver according to a first embodiment of the present disclosure. In more detail, FIG. 5 is a circuit diagram of the gate driver 130 according to the first embodiment of the present disclosure which includes the QB-node regulation unit 16 described above with reference to FIG. 4.

As described above, the gate driver 130 includes a plurality of stages, and each of the plurality of stages outputs a scan signal. Each of the plurality of stages includes a Q1-node control unit, a pull-up unit, a pull-down unit, and a Q-node stabilization unit, in addition to the QB-node regulation unit 16 described above with reference to FIG. 4. Referring to the block diagram shown in FIG. 3, the Q1-node control unit can correspond to the Q-node control unit 13, and the pull-up unit, the pull-down unit, and the Q-node stabilization unit can correspond to the pull-up unit 11, the pull-down unit 12, and the Q-node stabilization unit 14, respectively.

The Q1-node control unit includes a fourth transistor T4 and a fifth transistor T5.

The fourth transistor T4 can be referred to as a Q1-node activator and can have a gate electrode connected to the second gate clock signal line, a source electrode connected to the gate-start voltage line to which the gate-start voltage GVST is applied, and a drain electrode connected to the Q1-node Q1. The fourth transistor T4 is turned on by the second gate clock signal and the gate-on voltage of the gate-start voltage GVST to apply the gate-on voltage to the Q1-node Q1.

The fifth transistor T5 can be referred to as a Q1-node discharger and has a gate electrode connected to the QB-node QB, a source electrode connected to the Q1-node Q1, and a drain electrode connected to a gate-high voltage line to which the gate-high voltage VGH is applied. The fifth transistor T5 is turned on by the gate-low voltage applied to the QB-node QB to discharge the Q1-node Q1 to the gate-high voltage VGH. If it fails to discharge the Q1-node Q1 completely, the fifth transistor T5 degrades earlier, the reliability can be lowered. Therefore, by accurately applying the voltage to the QB-node QB, the fifth transistor T5 is turned on to sufficiently discharge the Q1-node Q1. The QB-node regulation unit allows the gate-low voltage VGL to be stably applied to the QB-node QB. This will be described in more detail together with the QB-node regulation unit.

The Q1-node control unit applies the gate-low voltage of the gate-start voltage GVST to the Q1-node Q1 or discharges it to the gate-high voltage VGH through the fourth transistor T4 and the fifth transistor T5.

The pull-up unit includes a sixth transistor T6 and a second capacitor CB.

The sixth transistor T6 can be referred to as a pull-up transistor and includes a gate electrode connected to a Q2-node Q2, a source electrode connected to the first gate clock signal line, and a drain electrode connected to a scan signal output line from which a scan signal is output. The sixth transistor T6 is turned on by the gate-on voltage applied to the Q2-node Q2 to output the first gate clock signal GCLK1 to the scan signal output line.

The second capacitor CB includes a first electrode coupled to the Q2-node Q2 and a second electrode connected to the scan signal output line. When the Q2-node Q2 is floating and the gate-low voltage is applied to the scan signal output line, the second capacitor CB is bootstrapped to stably turn on the sixth transistor T6.

Therefore, the pull-up unit can stably output the gate-on voltage to the scan signal output line through the sixth transistor T6 and the second capacitor CB.

The pull-up unit includes a seventh transistor T7. The seventh transistor T7 can be referred to as a pull-down transistor and includes a gate electrode connected to the QP-node QP, a source electrode connected to the scan signal output line, and a drain electrode connected to the gate-high voltage line. The seventh transistor T7 is turned on by the gate-on voltage of the QP-node QP to discharge the gate-high voltage VGH to the scan signal output terminal SRO. Accordingly, the pull-down unit can output the gate-off voltage to the scan signal output line through the seventh transistor T7.

The Q-node stabilization unit divides the Q-node Q described above with reference to FIG. 4 into a Q1-node Q1 and a Q2-node Q2 by an eighth transistor T8. The eighth transistor T8 includes a gate electrode connected to the gate-low voltage line, a source electrode connected to the Q2-node Q2, and a drain electrode connected to the Q1-node Q1. The eighth transistor T8 remains turned on by the gate-low voltage VGL applied to the gate electrode. When the Q2-node Q2 is bootstrapped with the second capacitor CB, the current between the source electrode and the drain electrode of the eighth transistor T8 becomes zero. In other words, while the Q2-node Q2 is bootstrapped and a voltage higher than the turn-on voltage is applied, the eighth transistor T8 is turned off so that the electrical connection between the Q2-node Q2 and the Q1-node Q1 is disconnected. Thus, even if the Q2-node Q2 is bootstrapped and the voltage is changed, it does not affect the Q1-node Q1, and thus it is possible to avoid the threshold characteristics of the fourth transistor T4 and the fifth transistor T5 connected to the Q1-node Q1 from being biased.

The Q-node stabilization unit divides the Q-node Q into the Q1-node Q1 and the Q2-node Q2 by the eighth transistor T8, so that the bias stress of the fourth transistor T4 and the fifth transistor T5 can be reduced and the reliability can be improved.

The QB-node regulation unit includes the first transistor T1, the second transistor T2, the third transistor T3, and the first capacitor CQP, which are indicated by the dashed-line boxes.

The first transistor T1 includes a gate electrode connected to the second gate clock signal line to which the second gate clock signal GCLK2 is applied, a source electrode connected to the gate-low voltage line to which the gate-low voltage VGL is applied, and a drain electrode connected to the QP-node QP. The first transistor T1 applies the gate-low voltage VGL to the QP-node QP in response to the second gate clock signal GCLK2.

The second transistor T2 includes a gate electrode connected to the Q1-node Q1, a source electrode connected to the second gate clock signal line, and a drain electrode connected to the QP-node QP. The second transistor T2 is turned on by the gate-on voltage applied to the Q1-node Q1 to apply the second gate clock signal GCLK2 to the QP-node QP.

The third transistor T3 includes a gate electrode connected to the QP-node QP, a source electrode connected to the first gate clock signal line to which the first gate clock signal GCLK1 is applied, and a drain electrode connected to the QB-node QB. The third transistor T3 is turned on by the gate-on voltage applied to the QP-node by the first transistor T1 or the second transistor T2 to apply the first gate clock signal GCLK1 to the QB-node QB.

The first capacitor CQP includes a first electrode connected to the QP-node QP and a second electrode connected to the QB-node QB. When the QP-node QP is floating and the gate-low voltage is applied to the QB-node QB, the first capacitor CQP is bootstrapped to stably turn on the third transistor T3.

Then, the QP-node QP is bootstrapped so that the voltage becomes lower than the gate-low voltage. The seventh transistor T7 of the pull-down unit is connected to the QP-node QP. Since the seventh transistor T7 is a buffer transistor that is required to be turned on for a long time, it occupies the largest area among the circuits of the stage. However, the size of the seventh transistor T7 can be reduced by connecting the QP-node QP, which is bootstrapped with the first capacitor CQP to a voltage lower than the gate-low voltage, to the seventh transistor T7. In this manner, the non-display area which is the bezel of the electroluminescence display device 100 can be reduced.

Then, the gate-low voltage VGL of the first gate clock signal GCLK1 is applied to the QB-node QB through the third transistor T3 which is turned on stably. The gate electrode of the fifth transistor T5 of the Q1-node control unit is connected to the QB-node QB. As described above, the gate-low voltage VGL with no threshold voltage drop is applied to the QB-node QB through the third transistor T3. Therefore, the reliability of the fifth transistor T5 is improved.

Figure 7:
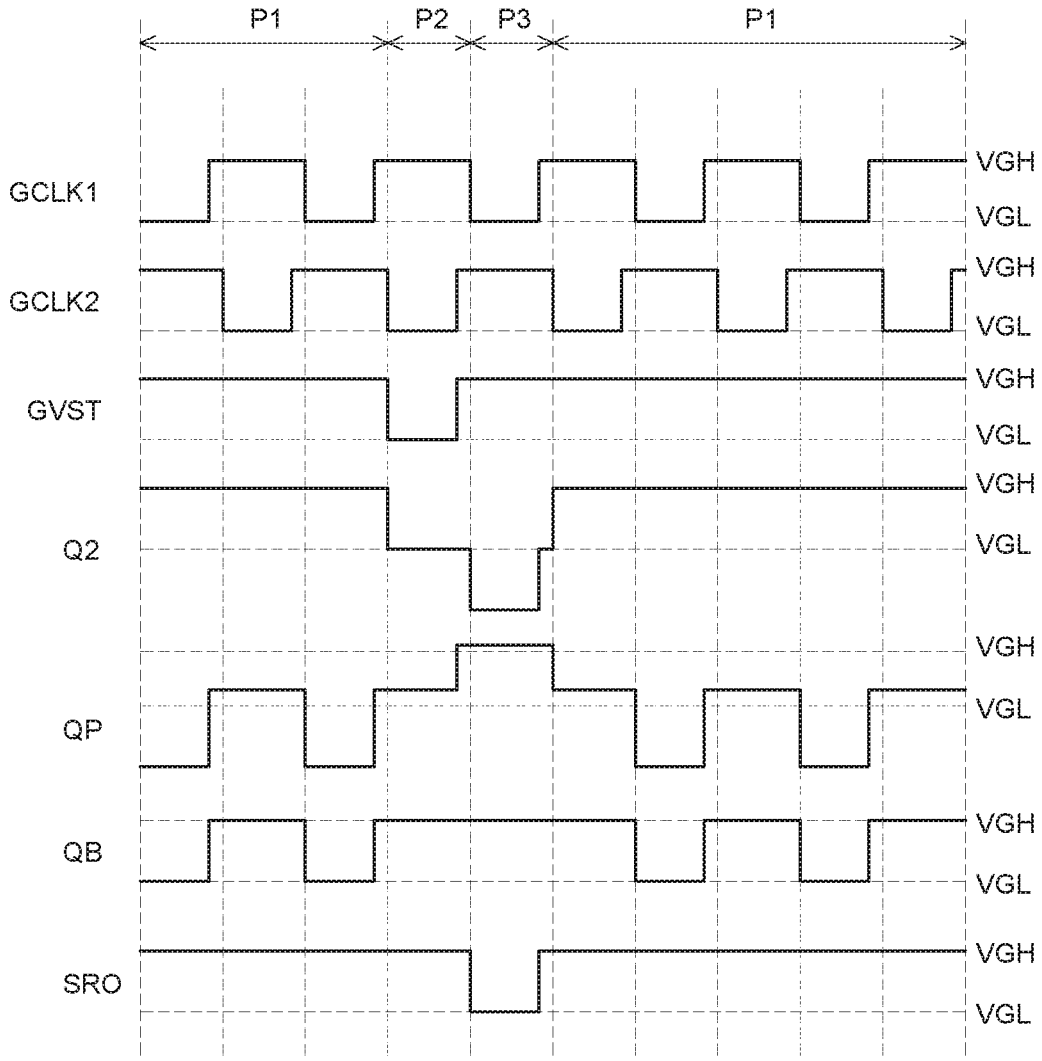
FIG. 7 is a waveform diagram for illustrating an operation of a gate driver of a display device according to an embodiment of the present disclosure.

FIG. 7 is a waveform diagram for illustrating an operation of a gate driver according to an embodiment of the present disclosure. In more detail, FIG. 7 shows the waveform diagram of the gate driver of FIG. 5.

Referring to FIGS. 5 and 7, in a first period P1, the first gate clock signal GCLK1 and the second gate clock signal GCLK2 swing between the gate-low voltage VGL and the gate-high voltage VGH and are in reversed phase to each other. The first gate clock signal GCLK1 and the second gate clock signal GCLK2 can have different gate clock cycles. For example, the gate clock cycle of the first gate clock signal GCLK1 can be longer than the gate clock cycle of the second gate clock signal GCLK2. In the first period P1, since the gate-start voltage GVST is held at the gate-high voltage VGH, the gate-high voltage VGH is applied to the Q1-node Q1 when the fourth transistor T4 is turned on. Since the eighth transistor T8 is in the turn-on state, the Q2-node Q2 is also maintained at the gate-high voltage VGH. Thus, the sixth transistor T6 maintains the turn-off state.

In the first period P1, the first transistor T1 is periodically turned on by the second gate clock signal GCLK2 to apply the gate-low voltage VGL to the QP-node QP. For example, a voltage obtained by subtracting the threshold voltage Vth of the first transistor T1 from the gate-low voltage VGL (VGL−Vth) is applied to the QP-node QP. Subsequently, the third transistor T3 is turned on by the voltage applied to the QP-node QP, to apply the gate-low voltage VGL of the first gate clock signal GCLK1 to the QB-node QB. When this happens, the voltage of the QP-node QP becomes lower than the gate-low voltage VGL due to the bootstrapping with the first capacitor CQP. The voltage of the QP-node QP swings between a voltage lower than the gate-low voltage VGL and a voltage equal to the difference between the gate-low voltage and the threshold voltage of the first transistor T1 in the first period P1, the transistor T7 is turned on to output the gate-high voltage VGH. Accordingly, the scan signal output terminal SRO is held at the gate-high voltage VGH during the first period P1. It is to be noted that the gate-low voltage VGL is the turn-on voltage only when p-type transistors are used. The voltage lower than the gate-low voltage VGL can be referred to as a voltage greater than the turn-on voltage irrespectively of the type of the transistors.

In a second period P2 which is a previous step for applying the gate-low voltage VGL to the scan signal output terminal SRO, the gate-start voltage GVST is applied. The fourth transistor T4 is turned on by the second gate clock signal GCLK2 and the gate-low voltage VGL of the gate-start voltage GVST so that the gate-low voltage VGL is applied to the Q1-node Q1. As the eighth transistor T8 is turned on, the voltage of the Q1-node Q1 is applied to the Q2-node Q2 through the eighth transistor T8. The gate-low voltage VGL of the Q2-node Q2 turns on the sixth transistor T6 so that the gate-high voltage VGH of the first gate clock signal GCLK1 is output.

Then, the second transistor T2 is turned on by the gate-low voltage VGL at the Q1-node Q1, and the first transistor T1 is turned on by the gate-low voltage VGL of the second gate clock signal GCLK2. Accordingly, a voltage equal to the difference between the gate-low voltage VGL and the threshold voltage Vth of the first transistor T1 and the second transistor T2 (VGL−Vth) is applied to the QP-node QP. The third transistor T3 is turned on by the voltage of the QP-node QP to apply the gate-high voltage VGH of the first gate clock signal GCLK1 to the QB-node QB. The fifth transistor T5 is turned off by the gate-high voltage VGH of the QB-node QB. The seventh transistor T7 is turned on by the voltage of the QP-node QP to output the gate-high voltage VGH. Therefore, in the second period P2, the sixth transistor T6 and the seventh transistor T7 are turned on to output the gate-high voltage VGH, so that the scan signal output terminal SRO has the gate-high voltage VGH.

In the third period P3 which is a step for applying the gate-low voltage VGL to the scan signal output terminal SRO, bootstrapping with the first capacitor CQP occurs. The first gate clock signal GCLK1 converted into the gate-low voltage VGL through the sixth transistor T6 in the on-state is applied to the scan signal output line. Simultaneously, the voltage of the Q2-node Q2 which is floating becomes lower than the gate-low voltage VGL by the bootstrapping with the second capacitor CB. Thus, the sixth transistor T6 is stably turned on to output the gate-low voltage VGL.

Then, the second gate clock signal GCLK2 becomes the gate-high voltage VGH so that the fourth transistor T4 and the first transistor T1 are turned off. Accordingly, the gate-high voltage VGH of the second gate clock signal GCLK2 is applied to the QP-node QP through the fourth transistor T4 and the first transistor T1. The third transistor T3 is turned off by the gate-high voltage VGH at the QP-node QP, and the voltage of the previous step is held at the QB-node QB. The voltage of the QB-node QB is held at the gate-high voltage VGH. The seventh transistor T7 and the fifth transistor T5 are turned off by the voltages at the QP-node QP and the QB-node QB. Therefore, in the third period P3, the gate-low voltage VGL is output through the sixth transistor T6 in the on-state so that the scan signal output terminal SRO has the gate-low voltage VGL.

Figure 6:
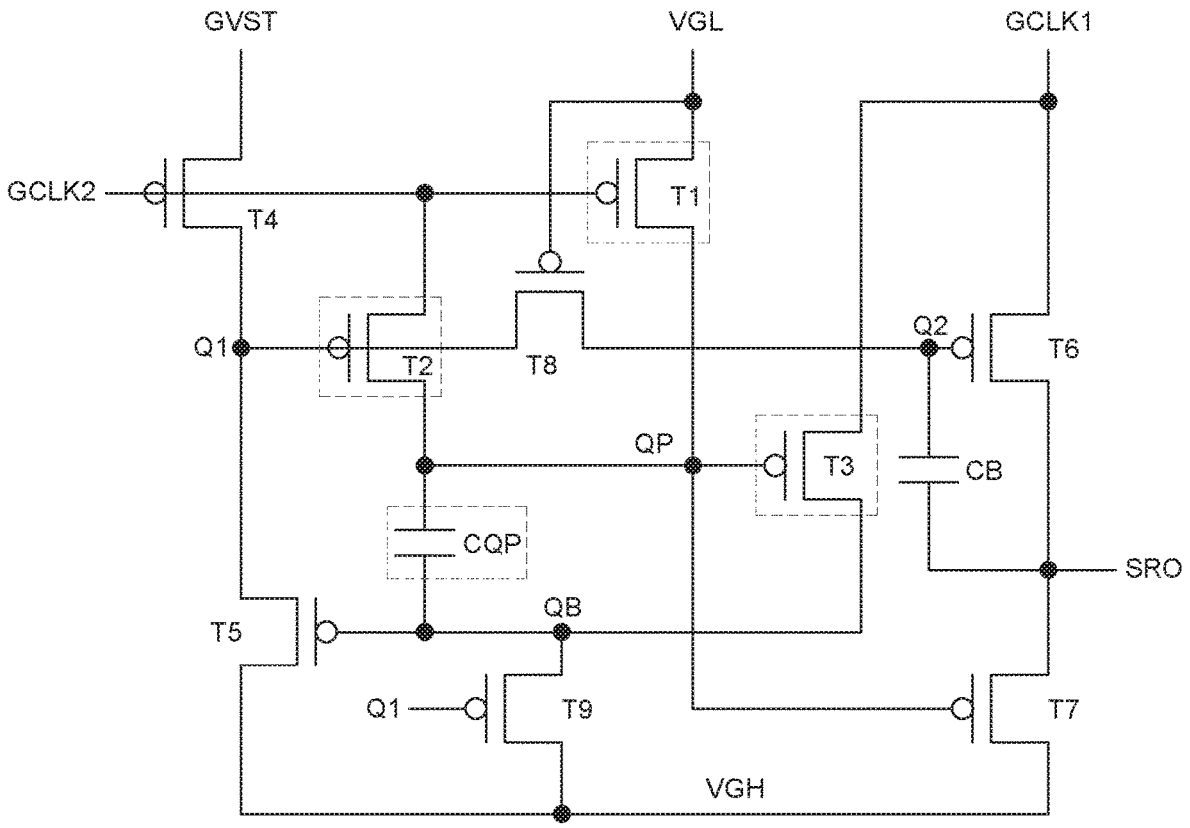
FIG. 6 is a circuit diagram of a gate driver of a display device according to a second embodiment of the present disclosure.

FIG. 6 is a circuit diagram of a gate driver according to a second embodiment of the present disclosure. In more detail, FIG. 6 is a circuit diagram of the gate driver 130 according to the second embodiment of the present disclosure which includes the QB-node regulation unit 16 described above with reference to FIG. 4.

As described above, the gate driver 130 includes a plurality of stages, and each of the plurality of stages outputs a scan signal. Each of the plurality of stages includes a Q1-node control unit, a pull-up unit, a pull-down unit, a Q-node stabilization unit and a QB-node stabilization unit, in addition to the QB-node regulation unit 16 described above with reference to FIG. 4. Referring to FIG. 3, the Q1-node control unit can correspond to the Q-node control unit 13, and the pull-up unit, the pull-down unit, the Q-node stabilization unit and the QB-node stabilization unit can correspond to the pull-up unit 11, the pull-down unit 12, the Q-node stabilization unit 14 and the QB-node stabilization unit 15, respectively.

The circuit diagram shown in FIG. 6 is substantially identical to the circuit diagram shown in FIG. 5 except that a ninth transistor T9 is added to the QB-node regulation unit 16 according to the first embodiment of the present disclosure. And, therefore, the redundant description will be omitted.

The QB-node stabilization unit includes the ninth transistor T9. The ninth transistor T9 includes a gate electrode connected to the Q1-node Q1, a source electrode connected to the QB-node QB, and a drain electrode connected to the gate-high voltage line. The ninth transistor T9 is turned on when the Q1-node Q1 is at the gate-on voltage, to discharge the QB-node QB to the gate-high voltage VGH.

A method of driving the QB-node stabilization unit will be described with reference to FIG. 7. The eighth transistor T8 is turned on in the first period P1 and the second period P2 except for the third period P3, and accordingly the voltage of the Q2-node Q2 is equal to the voltage of the Q1-node Q1. In the first period P1, since the Q1-node Q1 has the gate-high voltage VGH, the ninth transistor T9 remains turned off. In the second period P2, the Q1-node Q1 has the gate-low voltage VGL, and thus the ninth transistor T9 is turned on, to discharge the QB-node QB to the gate-high voltage VGH. In the third period P3, the Q1-node Q1 is floating and holds the voltage of the previous state, so that the gate-low voltage VGL is applied to the Q1-node Q1. Therefore, the ninth transistor T9 remains turned on. Therefore, by turning on the ninth transistor T9 in the second period P2 and the third period P3, the voltage of the QB-node QB is discharged to the gate-high voltage VGH, and the third transistor T3 is turned off, to stabilize the voltages at the Q1-node Q1 and the Q2-node Q2. In addition, by stabilizing the voltage of the Q1-node Q1, it is possible to suppress the degradation of the fifth transistor T5.

The embodiments of the present disclosure can also be described as follows.

According to an aspect of the present disclosure, there is provided an electroluminescent display device comprising sub-pixels connected to gate lines, and a gate driver configured to supply a scan signal to at least one of the gate lines, and including stages. One of the stages comprises a QB-node regulation unit configured to charge a QB-node and a QP-node to turn-on voltage by using a first gate clock signal and a second gate clock signal, and a pull-down unit configured to output a turn-off voltage in response to a voltage of the QP-node. The QB-node regulation unit comprises a QP-node control part configured to invert a phase of a voltage of a Q1-node and apply the voltage of the inverted phase to the QP-node, and a QB-node control part configured to bootstrap the QP-node. Accordingly, by employing the gate driver including the QB-node regulation unit that provides a stable voltage to the QB-node and the QP-node, the reliability of the gate driver can be improved, and the bezel of the electroluminescence display device can be reduced.

The QP-node control part can comprise a first transistor connected between a gate-low voltage line and the QP-node, and having a gate electrode connected to a second gate clock signal line, and a second transistor connected between the second gate clock signal line and the QP-node, and having a gate electrode connected to the Q1-node. The QB-node control unit can comprise a third transistor connected between a first gate clock signal line and the QB-node and having a gate electrode connected to the QP-node, and a first capacitor connected between the QP-node and the QB-node.

The one of the stages can further comprise a Q1-node control unit discharging the Q1-node to a turn-off voltage in response to the voltage of QB-node, and applying a gate-start voltage to the Q1-node in response to the second gate clock signal.

The Q1-node control unit can comprise a fourth transistor connected between a gate-start voltage line to which the gate-start voltage is applied and the Q1-node, and having a gate electrode connected to a second gate clock signal line, and a fifth transistor connected between the Q1-node and the gate-high voltage line and having a gate electrode connected to the QB-node.

The one of the stages can further comprise a pull-up unit outputting a turn-on voltage in response to the voltage of the Q2-node.

The pull-up unit can comprise a sixth transistor connected between a first gate clock signal line and the scan signal output line, and having a gate electrode connected to the Q2-node. The pull-down unit can comprise a seventh transistor connected between a gate-high voltage line and the scan signal output line, and having a gate electrode connected to the QP-node.

The one of the stages can further comprise a Q-node stabilization unit connected between the Q1 node and the Q2 node.

The one of the stages can further comprise a QB-node stabilization unit discharging the QB-node to the turn-off voltage in response to the voltage of the Q1-node.

According to another aspect of the present disclosure, there is provided a gate driver comprising a pull-up transistor having a gate electrode connected to a Q2-node to output a turn-on voltage, a pull-down transistor having a gate electrode connected to a QP-node to output a turn-off voltage, and a QB-node regulation unit configured to periodically provide a voltage greater than the turn-on voltage to the QP-node and periodically provide the turn-on voltage to the QB-node, with the turn-off voltage applied to the gate electrode of the pull-up transistor. Accordingly, the gate driver includes the QB-node regulation unit that provides a stable voltage to the QB-node and the QP-node, so that the reliability of the gate driver can be improved.

The gate driver can further comprise a Q-node stabilization unit connected between the Q2-node and a Q1-node, a Q1-node activator applying a gate-start voltage to the Q1-node, and a Q1-node discharger periodically discharging the Q1-node in response to a voltage of the QB-node.

The gate driver can further comprise a QB-node stabilization unit discharging the QB-node in response to the voltage of the Q1-node.

The QB-node regulation unit can comprise a first transistor connected between a gate-low voltage line and the QP-node and having a gate electrode connected to the second gate clock signal line, a second transistor connected between the second gate clock signal line and the QP-node and having a gate electrode connected to the Q1-node, a third transistor connected between a first gate clock signal line and the QB-node and having a gate electrode connected to the QP-node, and a first capacitor connected between the QP-node and the QB-node. The first gate clock signal and the second gate clock signal can be in reversed phase.

The gate driver can further comprise a second capacitor connected between the gate electrode and a drain electrode of the pull-up transistor.

The gate driver can further comprise an eighth transistor connected between the Q2-node and the Q1-node and having a gate electrode connected to a line to which the turn-on voltage is applied. The eighth transistor can be turned off while the voltage greater than the turn-on voltage is applied to the Q2-node by the second capacitor.

The voltage of the QP-node and the voltage of the QB-node can be the turn-off voltage, and the pull-up transistor can be turned on to output the turn-on voltage while a voltage of the Q2-node is greater than the turn-on voltage.

Thus far, embodiments of the present disclosure have been described in detail with reference to the accompanying drawings. However, the present disclosure is not limited to the embodiments, and modifications and variations can be made thereto without departing from the technical idea of the present disclosure. Accordingly, the embodiments described herein are merely illustrative and are not intended to limit the scope of the present disclosure. The technical idea of the present disclosure is not limited by the embodiments. Therefore, it should be understood that the above-described embodiments are not limiting but illustrative in all aspects. The scope of protection sought by the present invention is defined by the appended claims and all equivalents thereof are construed to be within the true scope of the present disclosure.

What is claimed is:

1. An electroluminescent display device comprising:

sub-pixels connected to gate lines; and a gate driver configured to supply a scan signal to at least one of the gate lines, and including stages, wherein one of the stages comprises:

a QB-node regulation unit configured to charge a QB-node and a QP-node to turn-on voltage by using a first gate clock signal and a second gate clock signal; and a pull-down unit configured to output a turn-off voltage in response to a voltage of the QP-node, and wherein the QB-node regulation unit comprises:

a QP-node control part configured to invert a phase of a voltage of a Q1-node and apply the voltage of the inverted phase to the QP-node; and a QB-node control part configured to bootstrap the QP-node.

2. The electroluminescent display device of claim 1, wherein the QP-node control part comprises:

a first transistor connected between a gate-low voltage line and the QP-node, and having a gate electrode connected to a second gate clock signal line; and a second transistor connected between the second gate clock signal line and the QP-node, and having a gate electrode connected to the Q1-node, and wherein the QB-node control unit comprises a third transistor connected between a first gate clock signal line and the QB-node, and having a gate electrode connected to the QP-node; and a first capacitor connected between the QP-node and the QB-node.

3. The electroluminescent display device of claim 1, wherein the one of the stages further comprises:

a Q1-node control unit discharging the Q1-node to a turn-off voltage in response to the voltage of QB-node, and applying a gate-start voltage to the Q1-node in response to the second gate clock signal.

4. The electroluminescent display device of claim 3, wherein the Q1-node control unit comprises:

a fourth transistor connected between a gate-start voltage line to which the gate-start voltage is applied and the Q1-node, and having a gate electrode connected to a second gate clock signal line; and a fifth transistor connected between the Q1-node and a gate-high voltage line, and having a gate electrode connected to the QB-node.

5. The electroluminescent display device of claim 1, wherein the one of the stages further comprises:

a pull-up unit outputting the turn-on voltage in response to the voltage of the Q2-node.

6. The electroluminescent display device of claim 5, wherein the pull-up unit comprises a sixth transistor connected between a first gate clock signal line and the scan signal output line, and having a gate electrode connected to the Q2-node, and wherein the pull-down unit comprises a seventh transistor connected between a gate-high voltage line and the scan signal output line, and having a gate electrode connected to the QP-node.

7. The electroluminescent display device of claim 5, wherein the one of the stages further comprises a Q-node stabilization unit connected between the Q1-node and the Q2-node.

8. The electroluminescent display device of claim 1, wherein the one of the stages further comprises a QB-node stabilization unit discharging the QB-node to the turn-off voltage in response to the voltage of the Q1-node.

9. A gate driver comprising:

a pull-up transistor having a gate electrode connected to a Q2-node to output a turn-on voltage;

a pull-down transistor having a gate electrode connected to a QP-node to output a turn-off voltage; and a QB-node regulation unit configured to periodically provide a voltage greater than the turn-on voltage to the QP-node and periodically provide the turn-on voltage to a QB-node, with the turn-off voltage applied to the gate electrode of the pull-up transistor, wherein the QB-node regulation unit comprises:

a third transistor connected between a first gate clock signal line and the QB-node and having a gate electrode connected to the QP-node; and a first capacitor connected between the QP-node and the QB-node.

10. The gate driver of claim 9, further comprising:

a Q-node stabilization unit connected between the Q2-node and a Q1-node;

a Q1-node activator applying a gate-start voltage to the Q1-node; and a Q1 -node discharger periodically discharging the Q1-node in response to a voltage of the QB-node.

11. The gate driver of claim 10, further comprising:

a QB-node stabilization unit discharging the QB-node in response to the voltage of the Q1-node.

12. The gate driver of claim 10, wherein the QB-node regulation unit further comprises:

a first transistor connected between a gate-low voltage line and the QP-node and having a gate electrode connected to a second gate clock signal line; and a second transistor connected between the second gate clock signal line and the QP-node and having a gate electrode connected to the Q1-node, wherein the first gate clock signal and the second gate clock signal are in reversed phase.

13. The gate driver of claim 10, wherein a voltage of the QP-node and the voltage of the QB-node are the turn-off voltage, and the pull-up transistor is turned on to output the turn-on voltage while a voltage of the Q2-node is greater than the turn-on voltage.

14. The gate driver of claim 9, further comprising:

a second capacitor connected between the gate electrode and a drain electrode of the pull-up transistor.

15. The gate driver of claim 14, further comprising:

an eighth transistor connected between the Q2-node and the Q1-node and having a gate electrode connected to a line to which the turn-on voltage is applied, wherein the eighth transistor is turned off while the voltage greater than the turn-on voltage is applied to the Q2-node by the second capacitor.

* * * * *